US005246992A

United States Patent [19]

Wick et al.

[11] Patent Number: 5,246,992

[45] Date of Patent: Sep. 21, 1993

[54] POLYESTER FIBERS MODIFIED WITH CARBODIIMIDES AND PROCESS FOR THEIR PREPARATION

[75] Inventors: Gottfried Wick; Erhard Krüger, both of Bobingen; Herbert Zeitler, Königsbrunn, all of Fed. Rep. of Germany

[73] Assignee: Hoechst Aktiengesellschaft, Frankfurt, Fed. Rep. of Germany

[21] Appl. No.: 582,321

[22] Filed: Sep. 13, 1990

[30] Foreign Application Priority Data

Sep. 15, 1989 [DE] Fed. Rep. of Germany ..... 3930845

[51] Int. Cl.[5] ..... C08K 5/29

[52] U.S. Cl. ..... 524/195; 525/437

[58] Field of Search ..... 525/437; 524/195

[56] References Cited

U.S. PATENT DOCUMENTS 3,193,522 7/1975 Neumann et al. ..... 524/195
3,975,329 8/1976 Barnewall et al. ..... 525/437

FOREIGN PATENT DOCUMENTS 1770495 11/1971 Fed. Rep. of Germany .
2020330 11/1971 Fed. Rep. of Germany .
2458701 7/1981 Fed. Rep. of Germany .
1-15604 3/1989 Japan .
1231975 5/1971 United Kingdom .
1330036 9/1973 United Kingdom .
1485294 9/1977 United Kingdom .

*Primary Examiner*—Paul R. Michl
*Assistant Examiner*—John J. Guarriello
*Attorney, Agent, or Firm*—Connolly and Hutz

[57] ABSTRACT

Polyester fibers and filaments which contain carboxyl end groups closed off by reaction with carbodiimides, wherein the closing off of the carboxyl end groups has predominantly been carried out by reaction with mono- and-/or biscarbodiimides which the fibers and filaments still contain in the free form, however in as little an amount as less than 30 ppm (by weight) of the polyester, the content of free carboxyl end groups is less than 3 meq/kg of polyester and the fibers and filaments still contain at least 0.05% by weight of at least one free polycarbodiimide or a reaction product which still contains reactive carbodiimide groups, and a process for their preparation are described.

The filaments described are particularly suitable for the production of paper making machinery screens.

20 Claims, No Drawings

POLYESTER FIBERS MODIFIED WITH CARBODIIMIDES AND PROCESS FOR THEIR PREPARATION

DESCRIPTION

The invention relates to man-made fibers of polyesters, preferably polyester monofilaments, which have been stabilized towards thermal and in particular hydrolytic degradation by addition of a combination of mono- and polycarbodiimides, and to suitable processes for their preparation.

It is known that on exposure to heat polyester molecules are split such that, for example in the case of a polyethylene terephthalate, the ester bond is cleaved to form a carboxyl end group and a vinyl ester, the vinyl ester then reacting further, acetaldehyde being split off. Such a thermal decomposition is influenced above all by the level of the reaction temperature, the residence time and possibly by the nature of the polycondensation catalyst.

In contrast, the resistance of a polyester to hydrolysis greatly depends on the number of carboxyl end groups per unit weight. It is known that an improvement in resistance to hydrolysis can be achieved by closing off these carboxyl end groups by chemical reactions. Reactions with aliphatic, aromatic and also cycloaliphatic mono-, bis-or polycarbodiimides have already been described in several incidences as such "closing-off" of the carboxyl end groups.

Thus, for example, German Offenlegungsschrift 1,770,495 describes stabilized polyethylene glycol terephthalates which have been obtained by addition of polycarbodiimides. Because of the slower rate of reaction which is generally to be observed with polycarbodiimides, it is necessary to ensure a relatively long residence time of the polycarbodiimide in the polyester melt. For this reason, polycarbodiimides have already been added during the polycondensation reaction of the polyesters. However, a number of disadvantages are associated with such a procedure. For example, a large number of by-products are formed because of the long residence time, and where relevant the actual polycondensation reaction of the polyester is also impeded.

In contrast, it is known that monocarbodiimides and biscarbodiimides react with polyester melts significantly faster. For this reason it is possible to shorten the time for mixing and reacting to the extent that these materials can be used together with the polyester granules to be melted, directly before the spinning extruder. German Offenlegungsschrift 2,020,330 may be mentioned as an example of the use of biscarbodiimides for this purpose, and German Auslegungsschrift 2,458,701 and Japanese Published Specification 1-15604/89 may be mentioned as an example of the use of monocarbodiimides.

The two published specifications mentioned last are specifically directed towards the preparation of stabilized polyester filaments, a slight excess of carbodiimide in the finished threads being recommended in both cases. According to German Auslegungsschrift 2,458,701, examples, the excess above the stoichiometrically required amount should be up to 7.5 meq/kg of polyester, whereas in Japanese Published Specification 1-15604/89 an excess of 0.005 to 1.5% by weight of the monocarbodiimide specifically recommended there is required. When calculating the stoichiometrically required amount, in both cases it is taken into account that some additional carboxyl groups are formed by thermal degradation due to the melting of the polymer for spinning, and these likewise have to be closed off. As can be seen from Japanese Published Specification 1-15604/89 in particular, it is of particular importance for the desired thermal and hydrolytic stability of the threads produced therefrom that the finished threads or monofilaments still contain free carbodiimide, since otherwise such materials would soon become useless, for example under the very aggressive conditions in a paper making machine. The Japanese Published Specification furthermore states that the use of polycarbodiimides does not correspond to the prior art already achieved.

A disadvantage of all the processes known to date which use an excess of mono- or biscarbodiimides is that because of the not insignificant volatility of these products and in particular of the cleavage products produced thermally and hydrolytically, such as, for example, the corresponding isocyanates and aromatic amines, a noticeable contamination of operating staff and the environment must be expected. Because of their particular properties, stabilized polyester threads are usually employed at elevated temperatures and in most cases in the presence of steam. Under these conditions, such contamination by excess additions of carbodiimide and secondary products is to be expected. Because of their volatility, it is to be expected that these compounds can diffuse out of the polyester or else, for example, can be extracted by solvents or mineral oils. No adequate depot action is thus guaranteed in the long term.

Given this prior art, there was still the object of discovering a stabilization of polyester filaments with which on the one hand, as far as possible, all the carboxyl end groups are closed off within short residence times, but on the other hand the contamination by volatile mono- or biscarbodiimides and their secondary products is at least reduced to a minimum because of the disadvantages associated with this.

Surprisingly, it has been found that this object can be achieved by using mixtures of certain carbodiimides. The invention thus relates to polyester fibers and filaments in which the closing off of the carboxyl end groups is predominantly carried out by reaction with mono- and/or biscarbodiimides, but the fibers and filaments according to the invention contain only very small amounts, if any, of these carbodiimides in the free form. In contrast, it is necessary for the polyester fibers and filaments still to contain at least 0.05% by weight of at least one polycarbodiimide, and this polycarbodiimide should be in the free form or at least still contain a few reactive carbodiimide groups. The desired polyester fibers and filaments having considerably improved resistances towards thermal and/or hydrolytic attacks should contain less than 3 meq/kg of carboxyl end groups in the polyester. Fibers and filaments in which the number of carboxyl end groups has been reduced to less than 2, preferably even less than 1.5 meq/kg of polyester are preferred. The content of free mono- and/or bis-carbodiimides should preferably be 0 to 20, in particular 0 to 10 ppm (by weight) of polyester.

It must be ensured that the fibers and filaments still contain polycarbodiimides or reaction products thereof still having reactive groups. Concentrations of 0.1 to 0.6, in particular 0.3 to 0.5% by weight of polycarbodiimide in the polyester fibers and filaments are preferred. The molecular weight of suitable carbodiimides is between 2000 and 15,000, preferably between 5000 and about 10,000.

To produce high performance fibers it is necessary to employ polyesters which have a high average molecular weight, corresponding to an intrinsic viscosity (limiting viscosity) of at least 0.64 [dl/g]. The measurements were carried out in dichloroacetic acid at 25° C.

The process according to the invention for the preparation of the stabilized polyester fibers and filaments claimed comprises addition of mono- and/or biscarbodiimide in an amount which corresponds to not more than the stoichiometrically required amount, calculated from the number of carboxyl groups, and additionally an amount of at least 0.15% by weight, based on the polyester, of a polycarbodiimide. This mixture of polyester and carbodiimides is then spun and further processed to threads and monofilaments or staple fibers in a known manner. To achieve the particularly low values of free mono- and/or biscarbodiimides, it is advantageous to employ less than 90% of the stoichiometrically required amount, preferably even only 50 to 85% of this amount, of mono- and/or biscarbodiimide. The stoichiometric amount is to be understood as the amount in milliequivalents per unit weight of the polyester which can and should react the terminal carboxyl groups of the polyester. When calculating the stoichiometrically required amount it should furthermore be taken into account that additional carboxyl end groups are usually formed during exposure to heat, such as, for example, melting of the polyester. These carboxyl end groups additionally formed during melting of the polyester material employed are also to be taken into account when calculating the stoichiometrically required amount of carbodiimides.

According to the present invention, it is advantageous to employ as spinning material polyesters which already have only a small amount of carboxyl end groups because of their preparation. This can be effected, for example, by use of the so-called solids condensation process. It has been found that the polyesters to be employed should contain less than 20, preferably even less than 10 meq of carboxyl end groups per kg. The additional increase due to the melting has already been taken into account in these values.

Polyesters and carbodiimides cannot be stored for any desired period at high temperatures. It has already been pointed out above that additional carboxyl end groups form during melting of polyesters. The carbodiimides employed can also decompose at the high temperatures of the polyester melts. It is therefore desirable for the contact or reaction time of the carbodiimide additives with the molten polyesters to be limited as far as possible. If melt extruders are used, it is possible to reduce this residence time in the molten state to less than 5, preferably less than 3 minutes. Limitation of the melting time in the extruder results only from the fact that adequate mixing of the reactants must take place for satisfactory reaction between the carbodiimide and the carboxyl end groups of the polyester. This can be effected by an appropriate design of the extruder or, for example, by using static mixers.

All filament-forming polyesters are in principle suitable for the use according to the present invention, i.e. aliphatic/aromatic polyesters, such as, for example, poly(ethylene terephthalates) or poly(butylene terephthalates), but completely aromatic and, for example, halogenated polyesters can also be employed in the same manner. Preferred units of filament-forming polyesters are diols and dicarboxylic acids, or correspondingly built hydroxycarboxylic acids. The main acid constituent of the polyesters is terephthalic acid, and other, preferably para or trans compounds, such as, for example, 2,6-naphthalenedicarboxylic acid, or else p-hydroxybenzoic acid, can of course also be mentioned as being suitable. Typical suitable dihydric alcohols would be, for example, ethylene glycol, propanediol, 1,4-butanediol and also hydroquinone and the like. Preferred aliphatic diols have 2 to 4 carbon atoms. Ethylene glycol is particularly preferred. However, longer-chain diols can be employed in amounts of up to about 20 mol-%, preferably less than 10 mol-%, for modification of the properties.

For particular industrial tasks, however, particularly high molecular weight polymers of pure polyethylene terephthalate and copolymers thereof with small additions of comonomers have proved to be suitable, as long as the exposure to heat justifies the properties of polyethylene terephthalate at all. Otherwise, a switch should be made to suitable known fully aromatic polyesters.

Polyester fibers and filaments according to the invention which are particularly preferred are accordingly those which consist predominantly or completely of polyethylene terephthalate, and in particular those which have a molecular weight corresponding to an intrinsic viscosity (limiting viscosity) of at least 0.64, preferably at least 0.70 [dl/g]. The intrinsic viscosities are determined in dichloroacetic acid at 25° C. The stabilization of the filaments and fibers according to the invention is achieved by addition of a combination of a mono- and/or biscarbodiimide on the one hand and a polymeric carbodiimide on the other hand. It is preferably to use monocarbodiimides, since they are distinguished in particular by a high rate of reaction in the reaction with the carboxyl end groups of the polyester. However, if desired, a proportion of them or their full amount can be replaced by corresponding amounts of biscarbodiimides in order to utilize the lower volatility which is already noticeable with these compounds. In this case, however, it should be ensured that the contact time is sufficiently long for an adequate reaction also to be guaranteed during mixing and melting in the melt extruder when biscarbodiimides are used.

In the process according to the invention, the carboxyl groups which still remain in the polyesters after the polycondensation should predominantly be closed off by react with a mono- or biscarbodiimide. A relatively small proportion of the carboxyl end groups will also react with carbodiimide groups of the polycarbodiimide additionally employed under these conditions according to the invention.

Instead of the carboxyl end groups, the polyester fibers and filaments according to the invention therefore essentially contain reaction products thereof with the carbodiimides employed. Mono- and biscarbodiimides, which must only occur, if at all, in the free form to a very small degree in the fibers and filaments, are the known aryl-, alkyl- and cycloalkyl-carbodiimides. The aryl nuclei in the diarylcarbodiimides, which are preferably employed, may be unsubstituted. However, aromatic carbodiimides which are substituted in the 2- or 2,6-position and thus sterically hindered are preferably employed. A large number of monocarbodiimides with steric hindrance of the carbodiimide group have already been listed in German Auslegungsschrift 1,494,009. Particularly suitable monocarbodiimides are, for example, N,N'-(di-o-tolyl)-carbodiimide and N,N'-(2,6,2',6'- tetraisopropyl)-diphenyl-carbodiimide. Biscarbodiimides which are suitable according to the invention are described, for example, in German Offenlegungsschrift 2,020,330.

Polycarbodiimides which are suitable according to the invention are compounds in which the carbodiimide units are bonded to one another via mono- or disubstituted aryl nuclei, possible aryl nuclei being phenylene, naphthylene, diphenylene and the divalent radical derived from diphenylmethane, and the substituents corresponding in nature and substitution site to the substituents of the mono-diarylcarbodiimides substituted in the aryl nucleus.

A particularly preferred polycarbodiimide is commercially available aromatic polycarbodiimide which is substituted by isopropyl groups in the o-position relative to the carbodiimide groups, i.e. in the 2,6- or 2,4,6-position on the benzene nucleus.

The polycarbodiimides contained in free or bonded form in the polyester filaments according to the invention preferably have an average molecular weight of 2000 to 15,000 but in particular 5000 to 10,000. As already mentioned above, these polycarbodiimides react with the carboxyl end groups at a significantly slower rate. When such a reaction occurs, initially only one group of the carbodiimide will preferentially react. However, the other groups present in the polymeric carbodiimide lead to the desired depot action and are the reason for the considerably improved stability of the resulting fibers and filaments. For this desired thermal and in particular hydrolytic resistance of the shaped polyester compositions it is therefore decisive that the polymeric carbodiimides present in them have not yet reacted completely, but still contain free carbodiimide groups for trapping further carboxyl end groups.

The resulting polyester fibers and filaments according to the invention can contain customary additives, such as, for example, titanium dioxide as a delustering agent or additives, for example for improving the dyeability or reducing electrostatic charging. Additives or comonomers which can reduce the flammability of the resulting fibers and filaments in a know manner are of course also similarly suitable.

It is also possible, for example, for color pigments, carbon black or soluble dyestuffs to be incorporated or already contained in the polyester melt. By admixing other polymers, such as, for example, polyolefins, polyesters, polyamides or polytetrafluoroethylene, it is possible to achieve, where appropriate, completely new textile technology effects. The addition of substances which have a cross-linking action and similar additives may also provide advantages for selected fields of use.

As already mentioned above, mixing and melting is necessary for the preparation of the polyester fibers and filaments according to the invention. This melting can preferably be carried out in a melt extruder directly before the actual spinning operation. The carbodiimides can be added by admixing to the polyester chips, impregnation of the polyester material with suitable solutions of the carbodiimides upstream of the extruder or by sprinkling or the like. Another method of addition, in particular for metering in the polymeric carbodiimides, is the preparation of stock batches in polyester (master batches). The polyester material to be treated can be mixed with these concentrates directly upstream of the extruder or, for example if a twin-screw extruder is used, also in the extruder. If the polyester material to be spun is not in the form of chips but is delivered continuously as a melt, for example, corresponding metering devices for the carbodiimide, if appropriate in molten form, must be provided.

The amount of the monocarbodiimide to be added depends on the carboxyl end group content of the starting polyester, taking into account the additional carboxyl end groups probably still formed during the melting operating. In order to achieve the desired minimum possible contamination of the environment and the operating staff, less than the stoichiometric amounts of mono- or biscarbodiimides are preferably used. Preferably, the amount of mono- or biscarbodiimides added should be less than 90% of the stoichiometrically calculated amount, in particular 50 to 85% of the stoichiometric amount of the mono-or biscarbodiimide corresponding to the carboxyl end group content. It should be ensured here that no losses arise from premature evaporation of the mono- or biscarbodiimides employed. A preferred form of addition for the polycarbodiimide is the addition of stock batches which contain a relatively high percentage, for example 15%, of polycarbodiimide in customary polymeric polyester granules.

The risk of side reactions which exist both for the polyester and for the carbodiimides employed under the exposure to heat by the joint melting operation should once more be referred to in particular. For this reason, the residence time of the carbodiimides in the melt should preferably be less than 5 minutes, in particular less than 3 minutes. Under these circumstances, with good mixing, the amounts of mono- and biscarbodiimides employed react quantitatively to a substantial extent, i.e. they are subsequently no longer detectable in the free form in the extruded filaments. Moreover, some of the carbodiimide groups of the polycarbodiimides employed react, even if to an admittedly significantly lower percentage, but these above all assume the depot function. As a result of this measure it has become possible for the first time to produce polyester fibers and filaments which are effectively protected from thermal and in particular hydrolytic degradation and contain virtually no free mono- or biscarbodiimide and also only very small amounts of cleavage and secondary products thereof, which can cause a nuisance or damage to the environment. As a result of the presence of polymeric carbodiimides, the desired long-term stabilization of the polyester materials treated in this way is ensured. It is surprising that this function is reliably performed by the polycarbodiimide, although stabilization experiments with the sole use of these compounds did not lead to the required stabilization.

The use of polymeric carbodiimides for the long-term stabilization also results in a considerably greater safety in the toxicological respect, in addition to the lower susceptibility to thermal decomposition and lower volatility of these compounds. This particularly applies to all the polymeric molecules of polycarbodiimides which have already been bonded chemically with at least one carbodiimide group with the polyester material via a carboxyl end group of the polyester.

EXAMPLES

The following examples are intended to illustrate the invention. In all the examples, dried polyester granules which have been subjected to condensation as solids and have an average carboxyl end group content of 5 meq/kg of polymer were employed. The monomeric carbodiimide used was N,N'2,2',6,6'-tetraisopropyl-diphenyl-carbodiimide. The polymeric carbodiimide employed in the experiments described below was an aromatic polycarbodiimide which contained benzene nuclei substituted with isopropyl groups in each case in the o-position, i.e. in the 2,6-or 2,4,6-position. It was employed not in the pure state but as a master batch (15% of polycarbodiimide in polyethylene terephthalate) (commercial product ®Stabaxol KE 7646 from Rhein-Chemie, Rheinhausen, Germany).

The carbodiimide was mixed with the master batch and the polymer material in containers by mechanical shaking and stirring. This mixture was then initially introduced into a single-screw extruder from Reifenhäuser, Germany, model S 45 A. The individual extruder zones had temperatures of 282° to 293° C. and the extruder was operated at a discharge of 500 g of melt-/minute using the customary spinnerets for monofilaments. The residence time of the mixtures in the molten state was 2.5 minutes. The freshly spun monofilaments were quenched in a water bath, after a short air zone, and then stretched continuously in two stages. The stretching ratio was 1:4.3 in all the experiments. The stretching temperature was 80° C. in the first stage and 90° C. in the second stage and the running speed of the spun threads after leaving the quenching bath was 32 m/minute. Heat setting was then carried out in a setting channel at a temperature of 275° C. All the spun monofilaments had a final diameter of 0.4 mm. As a stability test, the fineness-related maximum tensile strength (=tear strength) was tested on the resulting monofilaments once directly after production and a second time after 80 hours after storage of the monofilaments at 135° C. in a steam atmosphere. The tear strength was then determined again and the quotient of the residual tear strength and the original tear strength was calculated. This is a measure of the stabilizating action achieved by the additives.

EXAMPLE 1

In this example monofilaments were spun without any addition. The resulting samples of course contained no free monocarbodiimide and the carboxyl end group content was 6.4 meq/kg of polymer. The experimental conditions and the results obtained are summarized in the table which follows.

EXAMPLE 2

This example was also performed for comparison. A monofilament was again prepared under the same conditions as in Example 1, but 0.6% by weight of N,N'-(2,6,2',6'-tetraisopropyl-diphenyl)-carbodiimide alone was employed as a closing-off agent for the carboxyl groups. The amount of 0.6% by weight corresponds to a value of 16.6 meq/kg, and an excess of 10.2 meq/kg of polymer was thus used. Under these conditions, a polyester monofilament which has a very good stability towards thermal hydrolytic attack is obtained. A disadvantage is, however, the content of free monocarbodiimide at a level of 222 ppm in the finished products.

EXAMPLE 3

Example 1 was repeated here also for comparison purposes. This time, however, an amount of 0.876% by weight of the polycarbodiimide described above was added, and in particular in the form of a 15% strength master batch. This experiment was carried out to check once again the statements in the previous literature, according to which even with a noticeable excess of polycarbodiimide, probably because of the low reactivity, a thermal and hydrolytic resistance which is reduced compared with the prior art is to be observed. This example clearly shows that this is in fact the case. It is interesting that this amount of polycarbodiimide chosen already appears to lead to noticeable cross-linking of the polyester, as can be deduced from the significant increase in the intrinsic viscosity values. Such cross-linking in filament-forming polymers is in general admissible only within narrow limits, if it occurs strictly reproducibly and no spinning difficulties or difficulties during stretching of the filaments prepared therefrom are to be expected.

EXAMPLE 4

The process according to Example 1 and Example 2 was repeated, but amounts of monocarbodiimide which result in the stoichiometrically calculated value or a 20% excess of monocarbodiimide were now added. The results obtained here are also listed in the table which follows. In one run 4a, exactly the stoichiometrically required amount of monocarbodiimide was added, while in a run 4b an excess of 1.3 meq/kg of monocarbodiimide was added. As shown in the table, the relative residual strengths found after a time of 80 hours after treatment at 135° C. in a steam atmosphere do not correspond to the prior art. An excess of about 20%, such as can also already be seen, for example, from the numerical data of German Auslegungsschrift 2,458,701, likewise does not yet lead to the high hydrolytic resistances which can be achieved according to the prior art, for example according to Example 2. This means, however, that according to the prior art it has been possible to achieve a particularly good relative residual strength after exposure to heat and hydrolysis only with a considerable excess of monocarbodiimide. This is unavoidably associated with a high content of free monocarbodiimide.

EXAMPLE 5

Example 1 was repeated, but this time, in addition to monocarbodiimide, a polycarbodiimide was also employed, according to the invention. In one run 5a the amount of monocarbodiimide added was only 5.5 meq/kg, i.e. 0.9 meq/kg less than the equivalent amount, calculated from the stoichiometric requirement, was used. In percentage terms this is an amount 14.1% less than the equivalent amount, or only 85.9% of the stoichiometrically required amount was metered in. As can be seen from the table, under these conditions the content of free monocarbodiimide is within the desired limits, but in particular the thermal-hydrolytic resistance is entirely comparable, within the limits of error, with the best compositions known to date. The deviations found are not significantly different from the value of Example 2 or of Example 6. Example 5 was repeated as run 5b, but this time with an addition of exactly the equivalent amount of monocarbodiimide and an addition of polycarbodiimide in the concentration range claimed. The relative residual strength found was not influenced by the increase in the content of monocarbodiimide. Purely and simply a slight increase in the content of free monocarbodiimide was to be observed.

EXAMPLE 6

Example 5 was reworked, but this time with an excess of added monocarbodiimide of 1.3 meq/kg, or 20% more than required according to the stoichiometry. A corresponding excess was already employed in run 4b. Under the conditions chosen, it is found that this amount already gives an undesirably high content of free monocarbodiimide of 33 ppm, i.e. significantly more than in runs 5a and 5b is thus observed. Such a value should in fact no longer be tolerated, since in the runs of Example 5 it was demonstrated that the same relative residual strength, i.e. thus the same thermal-hydrolytic resistance, can also be achieved with a lower content of free monocarbodiimide and therefore a lower contamination of the environment. The degree to which the limit value imposed, of a content of 30 ppm of free monocarbodiimide, is exceeded is, of course, only slight here. Under the experimental conditions chosen, an excess of 1.3 meq/kg of monocarbodiimide leads to the limit imposed on the content of free monocarbodiimide being exceeded by only 10%. From this slight exceeding the additional doctrine can thus be deduced that under the experimental conditions chosen a small amount of monocarbodiimide has evidently been destroyed or evaporated. In an individual case it is thus also admissible to slightly exceed the stoichiometric amount to nevertheless still remain within the chosen limits of not more than 30 ppm of free monocarbodiimide/kg of polymer.

It is remarkable that here also the relative residual strength could still be significantly improved, compared with Example 4b, by the additional amount of polycarbodiimide.

The experimental results and reaction conditions are summarized in the table which follows. The monocarbodiimide addition is shown, on the one hand expressed as addition in percent by weight and then, in a second column, stated in meq/kg. The next column shows the excess or deficiency of monocarbodiimide addition compared with the stoichiometric calculation, and then in the next column the addition of polycarbodiimide is noted in percent by weight. Further columns show the measurement values of the monofilaments obtained, each of which had a diameter of 0.40 mm. The amount of carboxyl end groups in meq/kg is stated first, followed by the amount of free monocarbodiimide in ppm (weight values). The determination of the content of free carbodiimide was carried out by extraction and analysis by gas chromatography, similar to that described in Japanese Published Specification 1-15604-89. Further columns in which the relative residual strength and the intrinsic viscosity of the individual thread samples are stated follow.

| Example | Monocarbodiimide addition % by wt. | Monocarbodiimide addition meq/kg | Excess meq/kg | Polycarbodiimide % by wt. | COOH meq/kg | Free Monocarbodiimide ppm | Relative residual strength % | Intrinsic viscosity dl/g |
|---|---|---|---|---|---|---|---|---|
| 1 | — | — | — | — | 6.4 | 0 | 0 | 0.747 |
| 2 | 0.600 | 16.6 | +10.2 | — | 1.3 | 222 | 64 | 0.755 |
| 3 | — | — | — | 0.876 | 2.6 | <1 | 54 | 0.784 |
| 4a | 0.235 | 6.4 | ±0 | — | 2.8 | 2 | 34 | 0.743 |
| 4b | 0.278 | 7.7 | +1.3 | — | 1.9 | 23 | 53 | 0.756 |
| 5a | 0.200 | 5.5 | −0.9 | 0.415 | 1.0 | 8 | 61 | 0.768 |
| 5b | 0.235 | 6.4 | 0 | 0.387 | 1.8 | 10 | 61 | 0.746 |
| 6 | 0.278 | 7.7 | +1.3 | 0.359 | 1.8 | 33 | 64 | 0.758 |

We claim:

1. Polyester fibers and filaments which contain carboxyl end groups closed off by reaction with carbodiimides, wherein the closing-off of the carboxyl end groups has predominantly been carried out by reaction with mono- and/or biscarbodiimides which the fibers and filaments still contain in the free form, however, in as little an amount as less than 30 ppm (by weight) of the polyester, the content of free carboxyl end groups is less than 3 meq/kg of polyester and the fibers and filaments still contain at least 0.05% by weight of at least one free polycarbodiimide or a reaction product formed by the reaction of one or several, but not all, of the carbodiimide groups of the polycarbodiimide with free carboxylic acid groups of the polyester which still contains reactive carbodiimide groups.

2. The fibers and filaments as claimed in claim 1, wherein the content of free mono- and/or biscarbodiimides is 0 to 20, by weight of the polyester.

3. The fibers and filaments as claimed in claim 1, wherein the amount of free carboxyl end groups is less than 2, meq/kg of polyester.

4. The fibers and filaments as claimed in claim 1 which contain 0.1 to 0.6, by weight of at least one free polycarbodiimide or a reaction product which still contains reactive carbodiimide groups.

5. The fibers and filaments as claimed in claim 1, wherein the thread-forming polyester has an average molecular weight corresponding to an intrinsic viscosity of at least 0.64, measured in dichloroacetic acid at 25° C.

6. The fibers and filaments as claimed in claim 1, wherein the polycarbodiimide(s) employed has/have an average molecular weight of between about 2000 and 15,000.

7. A process for the preparation of polyester fibers and filaments stabilized with carbodiimides, which comprises adding to the polyester, before spinning, not more than the stoichiometrically required amount of a mono- and/or biscarbodiimide and at least 0.15% by weight, based on the polyester, of at least one polycarbodiimide and then spinning the mixture to threads.

8. The process as claimed in claim 7, wherein less than 90% of the stoichiometrically required amount, of mono- and/or biscarbodiimide is added.

9. The process as claimed in claim 7, wherein the polyester to be spun, without added carbodiimide, contains, after spinning, carboxyl groups which correspond to a stoichiometrically required amount of mono- or biscarbodiimide of less than 20, mVal/kg of polyester.

10. The process as claimed in claim 7, wherein the contact time between the molten polyester and the carbodiimide additions is less than 5.

11. The process as claimed in claim 7, wherein the polyester to be processed has an average molecular weight corresponding to an intrinsic viscosity of at least 0.64, measured in dichloroacetic acid at 25° C.

12. The process as claimed in claim 7, wherein the polycarbodiimide is added as a concentrate in a polymer, to the polyester to be processed.

13. The process as claimed in claim 7, wherein the carbodiimides are added immediately before spinning of the polyester upstream of or in the extruder.

14. The process as claimed in claim 7, wherein N,N'-(2,6,2'6'-tetraisopropyl)-diphenylcarbodiimide is used as the monocarbodiimide.

15. The process as claimed in claim 7, wherein the polycarbodiimide used is an aromatic polycarbodiimide which is substituted on the benzene nucleus by isopropyl groups in the o-position relative to the carbodiimide groupings, i.e. in the 2,6-or 2,4,6-position.

16. The filaments as claimed in claim 1, which are monofilaments having a circular or profiled cross-section and a diameter—if appropriate an equivalent diameter—of 0.1 to 2.0 mm.

17. Fibers and filaments as claimed in claim 1, wherein:

the content of free carboxyl end groups is less than 1.5 meg/kg of polyester;

the fibers and filaments contain 0.3 to 5% by weight of at least one free polycarbodiimide or said reaction product as defined in claim 1, formed by the reaction of one or several, but not all, of the carbodiimide groups of the polycarbodiimide with free carboxylic acid groups of the polyester which still contains reactive carbodiimide groups;

and the polycarbodiimide of polycarbodiimides employed has or have a weight average molecular weight of between about 5000 and 10,000.

18. The process as claimed in claim 7, wherein:

about 50 to 85% of the stoichiometrically required amount of mono- or bis-or mono- and bis-carbodiimide is added;

the polyester to be spun, without added carbodiimide, contains, after spinning, carboxyl groups which correspond to a stoichiometrically required amount of carbodiimide of less than 10 mVal/kg of polyester;

the contact time between the molten polyester and the carbodiimide additions is less than 3 minutes;

and wherein the polycarbodiimide is added to the polyester to be processed in the form of a master batch comprising a concentrated amount of polycarbodiimide in polyester.

19. A screen for a papermaking machine comprising filaments as claimed in claim 1.

20. A screen for a papermaking machine comprising filaments as claimed in claim 19.

* * * * *